United States Patent [19]

Dahlmann

[11] Patent Number: 4,926,824

[45] Date of Patent: May 22, 1990

[54] FUEL INJECTION SYSTEM

[75] Inventor: Gerd-Uwe Dahlmann, Wolfsburg, Fed. Rep. of Germany

[73] Assignee: Volkswagen AG, Wolfsburg, Fed. Rep. of Germany

[21] Appl. No.: 349,995

[22] Filed: May 10, 1989

[30] Foreign Application Priority Data

May 11, 1988 [DE] Fed. Rep. of Germany ..... 3816089

[51] Int. Cl.[5] ..... F02M 39/00

[52] U.S. Cl. ..... 123/450; 123/506; 123/603; 417/462

[58] Field of Search ..... 123/503, 506, 450, 500, 123/501, 502; 417/462

[56] References Cited

U.S. PATENT DOCUMENTS

| | | | |
|---|---|---|---|
| 3,161,138 | 12/1964 | Koster | 417/462 |
| 4,376,432 | 3/1983 | Davis | 123/506 |
| 4,499,884 | 2/1985 | Skinner | 417/462 |
| 4,550,702 | 11/1985 | Djordjevic | 417/462 |
| 4,662,825 | 5/1987 | Djordjevic | 123/506 |
| 4,667,641 | 5/1987 | Djordjevic | 417/462 |
| 4,691,679 | 9/1987 | Lakin | 123/503 |
| 4,725,209 | 2/1988 | Shibata | 417/462 |

*Primary Examiner*—Carl Stuart Miller

*Attorney, Agent, or Firm*—Brumbaugh, Graves, Donohue & Raymond

[57] ABSTRACT

In the embodiment described in the specification, a fuel injection system has a device for proportioning and distributing fuel to the individual cylinders of an internal combustion engine. The proportioning and distribution device has a distribution rotor driven in proportion to the speed of the engine. The distribution rotor is formed with high-pressure channels which communicate with a high-pressure chamber of a pressure pump for selective connection to the fuel injection lines leading to the cylinders of the engine. To control the termination of fuel injection in each cylinder, the distribution rotor has a control valve for connecting the high-pressure channels with the atmosphere. The control valve includes a sealing member actuable by a roller tappet which is mounted in a transverse bore of the distribution rotor. The roller tappet cooperates with a lifting ring surrounding the distribution rotor having camlike projections which are displaceable in the peripheral direction in the rotor housing.

6 Claims, 1 Drawing Sheet

FUEL INJECTION SYSTEM

BACKGROUND OF THE INVENTION

This invention relates to fuel injection systems for internal combustion engines which include a rotary device driven in accordance with the rotational speed of the engine for proportioning and distributing fuel to the individual cylinders of the engine.

Fuel injection systems having such fuel distribution. devices are used especially for the injection of fuel into the combustion chambers of an engine, for example a diesel engine. The rotary distribution device is usually in the form of a rotor which successively connects a pressurized fuel inlet with the injection lines leading to the individual combustion chambers of the internal combustion engine.

It is known that the running behavior and exhaust emissions, as well as the performance and fuel consumption, of an engine equipped with such a rotary fuel injection device can be improved considerably when the fuel quantities supplied to the individual cylinders of the engine are maintained within as narrow a range as possible. This can best be achieved by individual adjustment of the injection quantity supplied to each individual combustion chamber injection line. While the individual adjustment of fuel quantities has previously been provided by series-type injection pumps, an individual adjustment of fuel quantity in rotary distribution injection pumps has not previously been provided.

SUMMARY OF THE INVENTION

Accordingly, it is an object of the present invention to provide a rotary fuel injection device for internal combustion engines which accomplishes precise control of the termination of fuel injection and, thus, of fuel metering, as a function of the operating condition of the cylinders of an internal combustion engine in a simple and effective manner.

Another object of the invention is to provide a fuel injection system having a rotary valve device wherein the fuel injected during each individual injection process is controlled in accordance with the combustion chamber of the cylinder to which it is directed.

These and other objects of the invention are attained by providing a fuel injection system having a rotary fuel distributing device which selectively supplies fuel to a plurality of combustion chambers in an internal combustion engine wherein the rotary distributing device includes a control valve actuated in accordance with the rotary position of the fuel distributing device to individually control the amount of fuel distributed to the combustion chambers.

In one embodiment the control valve has a highpressure channel in the distribution rotor which follows the inner contour of a circular lifting ring. For this purpose the lifting ring has camlike projections which correspond to the cylinders of the internal combustion engine, so that the control valve ends each individual injection process by opening the high-pressure channel of the distribution rotor to the atmosphere.

According to another aspect of the invention, the camlike projections in the lifting ring are designed to be displaceable relative to one another with respect to their peripheral position on the lifting ring. For example, the lifting ring may have individual segments, each containing a camlike projection, which are adjustable relative to one another in the peripheral direction. This arrangement permits adjustment of the peripheral position on the lifting ring of each of the camlike projections which are assigned to specific cylinders of the internal combustion engine, making it possible to individually adjust and adapt the fuel qualities injected into the individual cylinders independently of displacement of the lifting ring depending upon the operating condition. This allows the running behavior, exhaust emissions, performance and fuel consumption of the engine as a whole to be improved while avoiding performance differences between the individual cylinders of the engine.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figure 1:
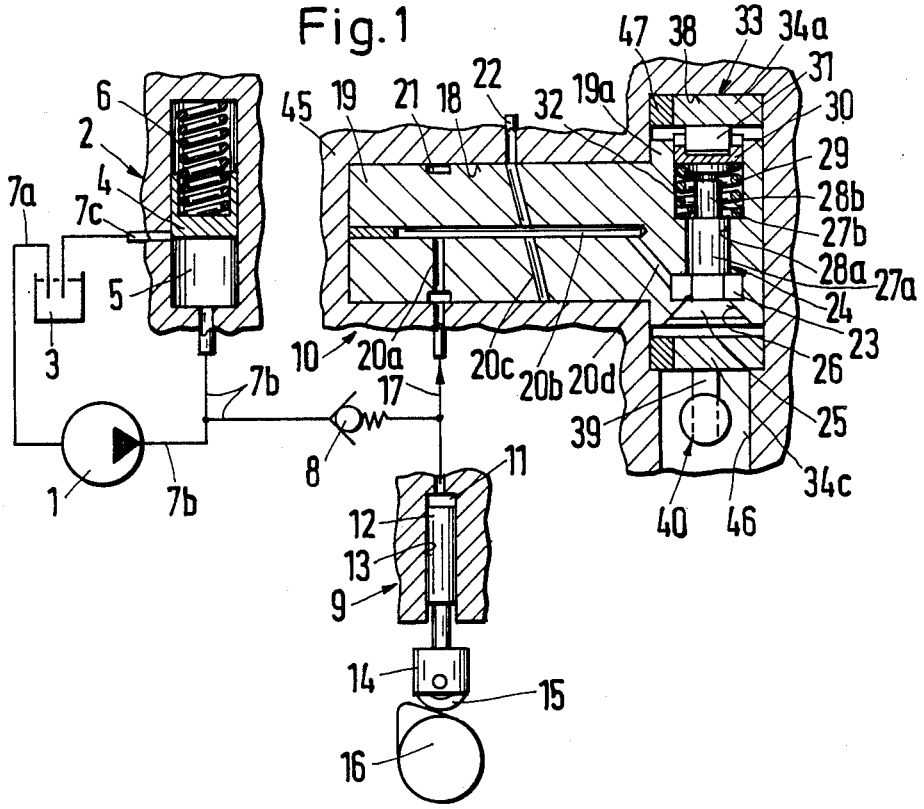
FIG. 1 is a schematic sectional view showing a representative embodiment of a fuel delivery system for a diesel internal combustion engine having a fuel injection system arranged according to the invention.

The typical embodiment of a fuel delivery system shown in FIG. 1 has a prefeed pump 1 which delivers fuel from a tank 3 through fuel lines *7a* and *7b* into a pressure reservoir arrangement collectively labeled 2. The reservoir 2 has a pressure piston 4, displaceable in a cylinder 5 against a spring 6 so that, when a predetermined system pressure is reached, fuel is released through an overflow *7c* back into the fuel tank 3. The fuel delivered by the prefeed pump 1 also passes through a check valve 8 to a high-pressure line 17 which is arranged between a high-pressure pump 9 and a fuel quantity proportioning valve 10. The high-pressure pump 9 has a high pressure chamber 11 at one end of a pump piston 12 which is displaceable in a cylinder 13, the piston being driven by a tappet 14 provided with a roller 15. A camshaft 16 actuates the roller tappet 14 and thereby provides for an oscillating lifting motion of the pump piston 12 in the cylinder 13. During this lifting motion the pressure of the fuel in the high-pressure chamber 11 of the high-pressure pump 9 is increased and this fuel, under high pressure, is delivered through the high-pressure line 17 to the fuel quantity proportioning valve 10, the check valve 8 being closed.

The fuel quantity proportioning valve 10 has a distribution rotor 19 supported for rotation in a cylindrical bore 18 of a housing 45. The rotor 10, just as the camshaft 16 of the high-pressure pump 9, is rotated in proportion to the speed of the internal combustion engine. In this connection, the distribution rotor 19 is formed with highpressure channels 20*a*–20*d*, extending in longitudinal and transverse directions or diagonally. These channels are connected periodically at one end by way of an annular groove 21 to the high-pressure line 17 and at the other end successively to a series of fuel injection lines 22, only one of which is shown in the drawings. The injection lines 22 lead to the cylinders of separate injection valves (not shown) for the combustion chambers of the internal combustion engine, where the valves inject the fuel directly into the combustion chambers of the engine. The number of injection lines, which advantageously are arranged around the periphery of the rotor 19 in the housing 45, therefore corresponds to the number of cylinders of the engine.

In addition, the distribution rotor 19 has a collarlike region 19a containing a control valve collectively labeled 24. A conical sealing member 25 in the control valve is actuated by a tappet consisting of a shaft 27a with an extension 27b supporting a head 30 carrying a roller 31. The sealing member 25 is urged against a conical valve seat 26 by a return spring 29 and the tappet of the control valve 24 is guided in a cylindrical bore 28a which extends perpendicularly to the axis of the distribution rotor 19. The end 30 of the tappet is guided in a large bore 28b and is urged by the valve spring 29 in the direction to close the valve. At the end 30 of the tappet, which is connected with the shaft 27a by way of a connecting extension 27b, the roller 31 projects beyond the outer periphery of the collarlike region 19a of the distribution rotor 19 and engages on the inner contour of a lifting ring, collectively labeled 33, which is supported for angular motion in a cylindrical recess 38 of the housing 45.

Figure 2:
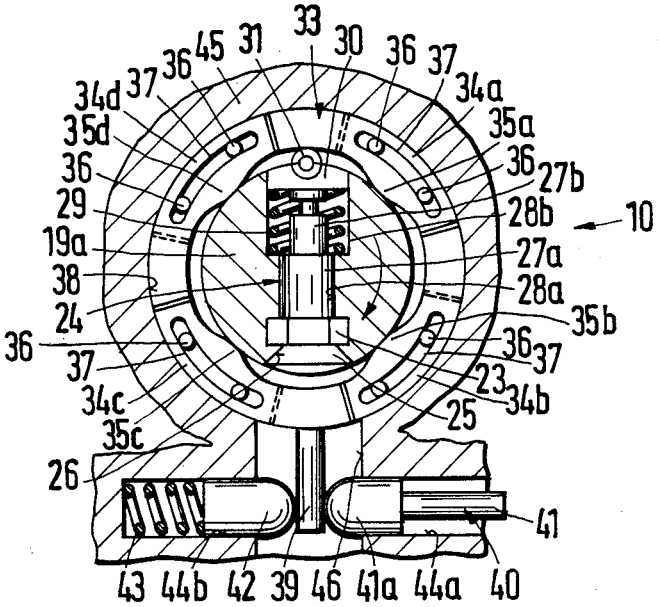
FIG. 2, is a cross-sectional view of the fuel injection system of FIG. 1, showing the arrangement of the quantity proportioning valve.

In the particular embodiment shown in the drawings the lifting ring 33, as best seen in FIG. 2, has a plurality of segments 34a–34d uniformly distributed around the periphery, each of which has a camlike projection 35a–35d extending radially inwardly and the number of segments 34a–34d corresponds to the number of cylinders of the internal combustion engine. The individual segments 34a–34d are separately held on a carrier ring 47 and their angular position relative to one another may be separately adjusted. For this purpose each segment has a longitudinal slot 37 extending in the peripheral direction, as shown in FIG. 2, through which two fastening screws 36, for example, are mounted to affix the segments to the continuous carrier ring 47.

The positions of the camlike projections 35a–35d of the lifting ring 33 determine the points in time at which, during rotation of the distribution rotor 19, the control valve 24 is opened by way of the roller tappet 27a. Specifically, at each approach of the tappet roller 31 to one of the camlike projections 35a–35d, the sealing member 25 is lifted from the valve seat 26 of the control valve 24 so that a high-pressure chamber 23 in communication with the highpressure channel 20d is opened to the atmosphere. This opening of the control valve 24 causes a drop in the pressure in the high-pressure channels 20a–20d, the high-pressure line 17 and the high-pressure chamber 11 of the high-pressure pump 9, as well as in the injection line 22 which is connected to them, so that fuel injection through that line is terminated.

In order to provide an adjustment of the fuel quantity injected which is dependent on operating conditions, in addition to the individual adjustment of the termination point of injection, and thereby change the injection of fuel supplied to all of the cylinders of the internal combustion engine, the lifting ring 33 may be displaced in its entirety in the peripheral direction. Thus, a clockwise displacement of the ring in the direction of rotation of the distribution rotor 19, shown by an arrow in FIG. 2, results in a later termination of fuel injection and, hence, an increase in the fuel quantity injected, for all of the combustion chambers. On the other hand, when the lifting ring 33 is moved in the opposite direction, i.e., counter-clockwise as shown in FIG. 2, there is a reduction of fuel injection time and, hence, of the fuel quantity injected.

To provide such an operating condition-dependent displacement of the lifting ring 33, the ring is provided with a radially extending adjusting lever 39 within a recess 46 of the housing 45 and an adjusting device 40 engaging the lever 39. As best seen in FIG. 2, the adjusting device 40 consists of a tappet 41a having an operating rod 41 which is movable in a bore 44a. The tappet 41a is actuated by a servomotor, not shown in the drawing, which may be driven hydraulically, pneumatically, electrically or in some other way in response signals from one or more sensors, not shown, which detect an operating condition of the internal combustion engine. Such sensors may, for example, be conventional speed sensors for detecting the speed of the engine, or performance sensors for detecting performance characteristics of the engine.

Displacement of the lever 39 by the actuating tappet 41a counteracts the urging of a restoring device which consists of a restoring tappet 42 engaged by a restoring spring 43 and movable in a bore 44b.

In the fuel injection system shown in the drawing, which may be included in an internal combustion engine arranged, for example, in a vehicle, the feed and proportioning of highly pressurized fuel is effected by way of the high-pressure channel system, consisting of the channels 20a–20d, provided in the distribution rotor 19 of the injection-quantity proportioning device 10. During each delivery stroke of the high-pressure pump 9 this high-pressure channel system 20a–20d is connected with one of the injection lines 22 leading to an injection nozzle of a cylinder of the engine where the fuel is sprayed into the combustion chamber. This continues until the control valve 24 is opened by engagement of the valve tappet roller 31 with one of the camlike projections 35a–35d in the lifting ring 33, thereby relieving the pressure in the high-pressure channel system.

In this connection, the termination of injection and of the injection time and, as a result, the quantity of fuel injected, may be varied as a function of the operating condition of the engine by rotation of the lifting ring 33 as a whole, as previously mentioned. In addition, the fuel injection system pursuant to the invention also permits adjusting and adapting the injection times for the individual cylinders of the engine separately and relative to one another, to eliminate differences in injection quantities between the individual cylinders and thereby obtain improved running behavior as well as to even out the performance and combustion behavior of the internal combustion engine as a whole.

Although the invention has been described herein with reference to a specific embodiment, many modifications and variations therein will readily occur to those skilled in the art. For example, instead of having segments provided with camlike projections, the lifting ring may, for example, have individual cam elements adjustable relative to one another by eccentric displacement. Accordingly, all such variations and modifications are included within the intended scope of the invention.

I claim:

1. A fuel injection system comprising a device for proportioning and distributing fuel to the individual cylinders of an internal combustion engine including a pressure pump having a high-pressure chamber, a distribution rotor driven in proportion to the speed of the engine and having high-pressure channels communicating with the high-pressure chamber of the pressure pump for variable connection with injection lines leading to the cylinders of the engine, a control valve in the distribution rotor connecting the highpressure channels therein with an outlet to control the end of fuel injection and actuable by a roller tappet disposed in a transverse bore of the distribution rotor, and a plurality of camlike projections surrounding the distribution rotor and engageable by the roller tappet which are displaceable in the peripheral direction.

2. A fuel injection system according to claim 1 wherein the camlike projections correspond in number to the number of cylinders in the internal combustion engine and are mounted on a lifting ring so as to be adjustable relative to one another in the peripheral direction.

3. A fuel injection system according to claim 2, wherein the lifting ring has individual segments which are adjustable relative to one another in the peripheral direction, each segment containing a camlike projection.

4. A fuel injection system according to claim 3, wherein the individual segments correspond in the number to the cylinders of the internal combustion engine and are separately adjustable with respect to one another on a carrier ring of the lifting ring.

5. A fuel injection system according to any of claims 1 to 4, including an adjusting device which is controllable as a function of a variable state of the internal combustion engine arranged to cause peripheral displacement of the lifting ring.

6. A fuel injection system according to claim 5, wherein the lifting ring has a radially extending actuating lever and the adjusting device acts on the actuating lever against the urging of a restoring device.

* * * * *